US010243680B2

(12) United States Patent
Arimoto

(10) Patent No.: US 10,243,680 B2
(45) Date of Patent: Mar. 26, 2019

(54) AUDIO PROCESSING DEVICE AND AUDIO PROCESSING METHOD

(71) Applicant: Yamaha Corporation, Hamamatsu, Shizuoka (JP)

(72) Inventor: Keita Arimoto, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 15/936,009

(22) Filed: Mar. 26, 2018

(65) Prior Publication Data

US 2018/0219638 A1 Aug. 2, 2018

(30) Foreign Application Priority Data

Sep. 30, 2015 (JP) ..... 2015-195237

(51) Int. Cl.

| | |
|---|---|
| ***H04H 60/04*** | (2008.01) |
| ***H04R 3/00*** | (2006.01) |
| *G10L 25/51* | (2013.01) |
| *H04S 1/00* | (2006.01) |
| *H04S 7/00* | (2006.01) |

(52) U.S. Cl.

CPC ..... *H04H 60/04* (2013.01); *H04R 3/005* (2013.01); *G10H 2210/056* (2013.01); *G10H 2210/066* (2013.01); *G10H 2210/281* (2013.01); *G10L 25/51* (2013.01); *H04R 2430/01* (2013.01); *H04S 1/007* (2013.01); *H04S 7/305* (2013.01); *H04S 2400/13* (2013.01); *H04S 2400/15* (2013.01)

(58) Field of Classification Search

CPC ..... H04R 3/00; G10L 25/51

USPC ..... 381/62, 107, 119; 369/4

See application file for complete search history.

(56) References Cited

U.S. PATENT DOCUMENTS

| | | | | |
|---|---|---|---|---|
| 5,406,022 A * | 4/1995 | Kobayashi | ..... | G10H 1/0091 84/622 |
| 5,896,358 A * | 4/1999 | Endoh | ..... | G11B 27/034 369/275.3 |
| 8,737,638 B2 | 5/2014 | Sakurada et al. | | |

FOREIGN PATENT DOCUMENTS

| | | | | |
|---|---|---|---|---|
| JP | S55-035558 U1 | 3/1980 | | |
| JP | 04306697 A * | 10/1992 | ..... | G10H 1/0091 |
| JP | H04-06697 A | 10/1992 | | |
| JP | H09-46799 A | 2/1997 | | |
| JP | 2004-328377 A | 11/2004 | | |
| JP | 2004328377 A * | 11/2004 | | |
| JP | 2006-259401 A | 9/2006 | | |
| JP | 2010-034983 A | 2/2010 | | |
| JP | 2011-217328 A | 10/2011 | | |
| JP | 2014-049885 A | 3/2014 | | |

(Continued)

OTHER PUBLICATIONS

International Search Report in PCT/JP2016/078752 dated Dec. 20, 2016.

*Primary Examiner* — Melur Ramakrishnaiah

(74) *Attorney, Agent, or Firm* — Global IP Counselors, LLP

(57) ABSTRACT

An audio processing device has an identification module and an adjustment information acquisition module. The identification module identifies each of the musical instruments that correspond to each of the audio signals. The adjustment information acquisition module acquires adjustment information for adjusting each of the audio signals described above according to the combination of the identified musical instruments.

18 Claims, 4 Drawing Sheets

(56) References Cited

FOREIGN PATENT DOCUMENTS

| | | | | | |
|---|---|---|---|---|---|
| JP | 2014049885 | A | * | 3/2014 | |
| JP | 2015-011245 | A | | 1/2015 | |
| JP | 2015-12592 | A | | 1/2015 | |
| JP | 2015012592 | A | * | 1/2015 | ..... G10H 1/46 |
| JP | 2015-080076 | A | | 4/2015 | |
| JP | 2017-067901 | A | | 4/2017 | |
| JP | 2017-067903 | A | | 4/2017 | |

* cited by examiner

| Inst. | Vol. | Pan | Rev. | Comp. |
|---|---|---|---|---|
| Vocal | 1.0 | 0.5 | 0.4 | On |
| Guitar | 0.8 | 0.5 | 0.4 | |

| Inst. | Vol. | Pan | Rev. | Comp. |
|---|---|---|---|---|
| Vocal | 1.0 | 0.5 | 0.4 | On |
| Keyboard | 0.5 | 0.5 | 0 | |

| Inst. | Vol. | Pan | Reverb. | Comp. | Side chain |
|---|---|---|---|---|---|
| Vocal | 1.0 | 0.5 | 0.4 | On | |
| Guitar | 0.6 | 0.5 | 0 | | |
| Bass | 0.6 | 0.5 | 0 | | Kick |
| Kick | 0.8 | 0.5 | | On | |
| Snare | 0.7 | 0.7 | 0.1 | | |
| TopL | 0.3 | 0.3 | | | |
| TopR | 0.3 | 0.7 | | | |

| Inst. | Vol. | Pan | Reverb. | Comp. | Side chain |
|---|---|---|---|---|---|
| Vocal | 1.0 | 0.5 | 0.4 | On | |
| Guitar | 0.6 | 0.35 | 0 | | |
| Guitar | 0.6 | 0.65 | 0 | | |
| Bass | 0.6 | 0.5 | 0 | | Kick |
| Kick | 0.8 | 0.5 | | On | |
| Snare | 0.7 | 0.7 | 0.2 | | |
| TopL | 0.3 | 0.3 | | | |
| TopR | 0.3 | 0.7 | | | |

AUDIO PROCESSING DEVICE AND AUDIO PROCESSING METHOD

CROSS-REFERENCE TO RELATED APPLICATIONS

This application is a U.S. continuation application of International Application No. PCT/JP2016/078752, filed Sept. 29, 2016, which claims priority to Japanese Patent Application No. 2015-195237, filed Sept. 30, 2015. The entire disclosures of International Application No. PCT/JP2016/078752 and Japanese Patent Application No. 2015-195237 are hereby incorporated herein by reference.

BACKGROUND

Field of the Invention

The present invention relates to an audio processing device and an audio processing method.

Background Information

For example, a mixer is known, which allocates audio signals input from many devices on a stage such as microphones and instruments, and the like, to respective channels, and which controls various parameters for each channel, such as the signal level (volume value). Specifically, for example, in view of the fact that when there are a large number of devices that are connected to the mixer, it requires time to check the wiring that connects the mixer and the devices. Japanese Laid-Open Patent Publication No. 2010-34983 (hereinafter referred to as Patent Document 1) discloses an audio signal processing system in which identification information of each device is superimposed on the audio signal as watermark information, so that it becomes possible to easily check the wiring conditions between the devices and the mixer.

SUMMARY

However, in Patent Document 1 described above, while it is possible to confirm the wiring conditions between the devices and the mixer, it is necessary that the user understand each of the functions of the mixer, such as the input gain, the faders, and the like, and to carry out the desired settings according to the given location.

An object of the present invention is to realize an audio signal processing device in which each audio signal is automatically adjusted according to, for example, the combination of the connected musical instruments.

One aspect of the audio processing device according to the present invention comprises an identification means that identifies each of the musical instruments that correspond to each of the audio signals, and an adjustment information acquisition means that acquires adjustment information for adjusting each of the audio signals described above according to the combination of the identified musical instruments.

The audio processing method according to the present invention is characterized by identifying each of the musical instruments that correspond to each of audio signals, and acquiring adjustment information too adjusting each of the audio signals described above according to the combination of the identified musical instruments.

Another aspect of the audio processing device according to the present invention comprises an identification means that identifies each of the musical instruments that correspond to each of the audio signals, an adjustment means that adjusts each of the audio signals according to the combination of the identified musical instruments, and a mixing means that mixes the identified audio signals.

DETAILED DESCRIPTION OF THE EMBODIMENTS

Figure 1:
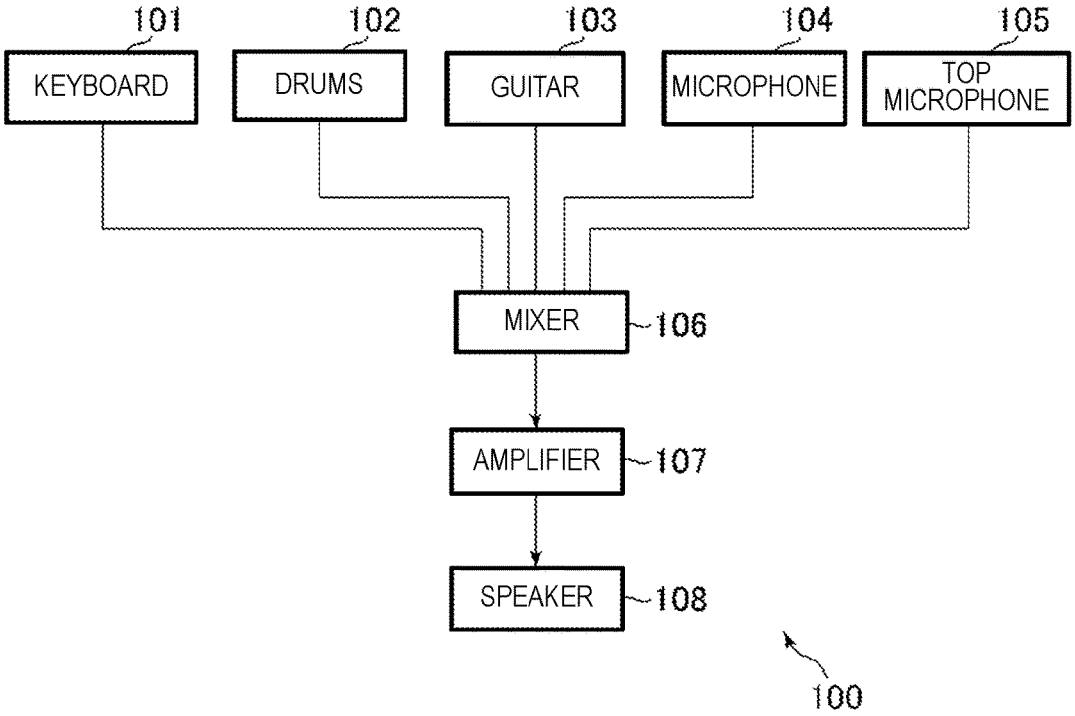
FIG. 1 is a view illustrating one example of an overview of the audio signal processing system according to the present embodiment.

An embodiment of the present invention will be described below with reference to the drawings. Moreover, identical elements have been assigned the same reference symbols in the drawings, and redundant, descriptions have been omitted.

FIG. 1 is a view illustrating one example of an overview of the audio signal processing system according to the present embodiment. As shown in FIG. 1, the audio signal processing system 100 comprises, for example, musical instruments such as a keyboard 101, drums 102, a guitar 103, a microphone 104 and a top microphone 105, a mixer 106, an amplifier 107, and a speaker 108. The musical instruments can include other instruments such as a bass, etc.

The keyboard 101 is, for example, a synthesizer or an electronic piano, which outputs audio signals according to the performance of a performer. The microphone 104, for example, picks up the voice of a singer and outputs the picked-up sound as an audio signal. The drums 102 comprise, for example, a drum set, and microphones that pick up sounds that are generated by striking a percussion instrument (for example, a bass drum, a snare drum, etc.) included in the drum set. A Microphone is provided for each percussion instrument, and outputs the picked-up sound as an audio signal. The guitar 103 comprises, for example, an acoustic guitar and a microphone, and the microphone picks up the sound of the acoustic guitar and outputs the sound as an audio signal. The guitar 103 can be an electric acoustic guitar or an electric guitar. In that case, it is not necessary to provide a microphone. The top microphone 105 is a microphone installed above the sounds from a plurality of musical instruments, for example, the drum set, and picks up sounds front the entire drum set and outputs the sound as audio signals. This top microphone 105 will inevitably picks up sound, albeit at low volume, from other musical instruments besides the drum set.

The mixer 106 comprises a plurality of input terminals, and electrically adds, processes, and outputs audio signals from the keyboard 101, the drums 102, the guitar 103, the microphone 104, and the like, input to each of the input terminals. The specific configuration of the mixer 106 will be described further below.

The amplifier 107 amplifies and outputs to the speaker 108 audio signals that are output from the output terminal of the mixer 106. The speaker 108 outputs sounds in accordance with the amplified audio signals.

Figure 2:
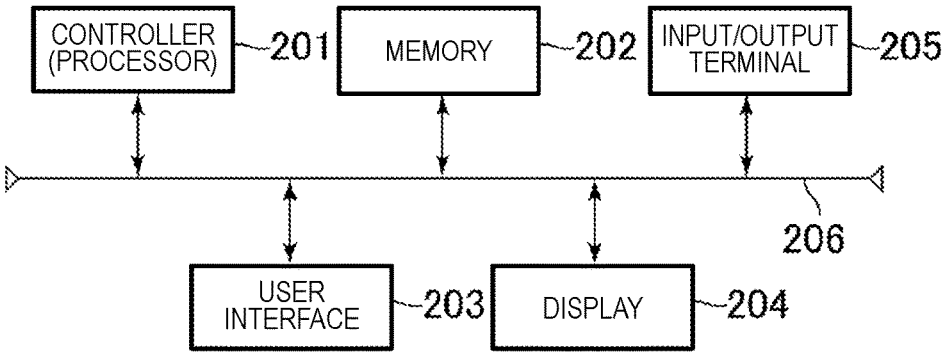
FIG. 2 is a view for explaining the overview of the mixer shown in FIG. 1.

Next, the configuration of the mixer 106 according to the present embodiment will be described. FIG. 2 is a view for explaining the overview of the configuration of the mixer 106 according to the present embodiment. As shown in FIG. 2, the, mixer 106 comprises, for example, an electronic controller 201, a memory 202, a user interface 203, a display 204, and an, input/output terminal 205. Moreover, the electronic controller 201, the memory 202, the user interface 203, the display 204, and the input/output terminal 205 are connected to each other by an internal bus 206.

The electronic controller 201 for example, includes a CPU, an MPU, or the like, which is operated according to a program that is stored in the memory 202. The electronic controller 201 includes at least one processor. The memory 202 is configured from information storage media such as ROM, RAM, and a hard disk, and is an information storage medium that holds programs that are executed by the at least one processor of the electronic controller 201. In other words, the memory 202 is any computer storage device or any computer readable medium with the sole exception of a transitory, propagating signal. For example, the memory 202 can be a computer memory device which can be nonvolatile memory and volatile memory.

The memory 202 also operates as a working memory of the electronic controller 201. Moreover, the programs can be provided b downloading via a network (not shown), or provided by various information storage media that can be read by a computer, such as a CD-ROM or a DVD-ROM.

The user interface 20 outputs to the electronic controller 201 the content of an instruction operation of the user, such as volume slides, buttons, knobs, and the like, according to the instruction operation.

The display 204 is, for example, a liquid-crystal display, an organic EL display, or the like, and displays information in accordance with instructions from the electronic controller 201.

The input/output terminal 205 comprises a plurality of input terminals and an output terminal. Audio signals from each of the musical instruments, such as the keyboard 101, the drums 102, the guitar 103, and the microphone 104, and from the top microphone 105 are input to each of the input terminals. In addition, audio signals obtained by electrically adding and processing the input audio signals described above are output from the output terminal. The above-described configuration of the mixer 106 is merely an example, and the invention is not limited thereto.

Figures 3, 4A, 4B:
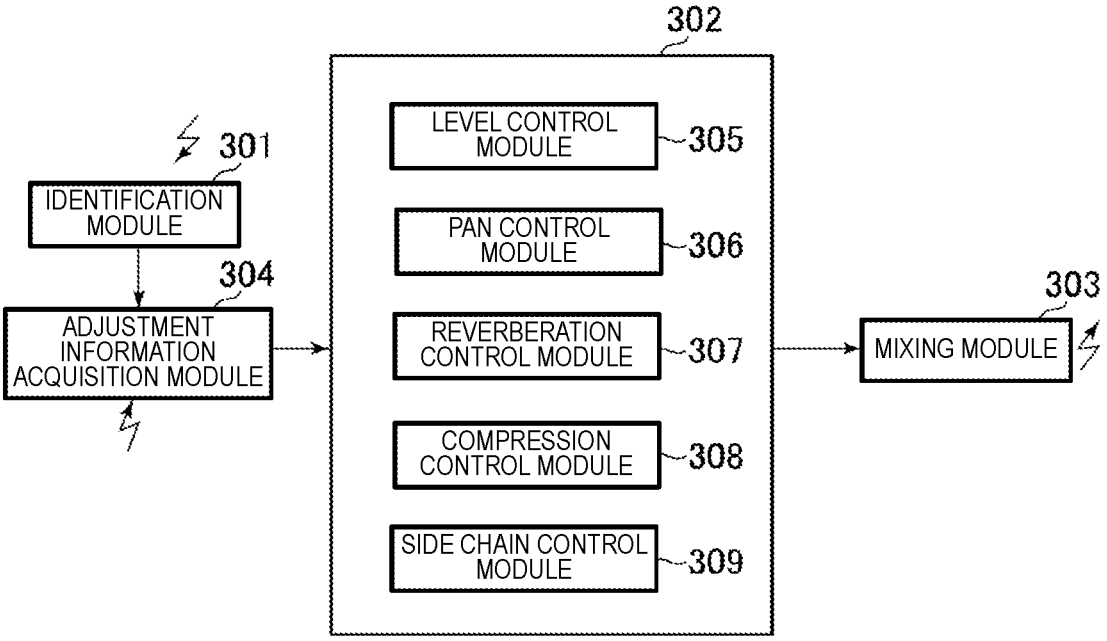
FIG. 3 is a view for explaining the functional configuration of the electronic controller illustrated in FIG. 1.
FIG. 4A shows one example of adjustment information in a case of a solo singing accompaniment.
FIG. 4B shows another example of adjustment information in a case of a solo singing accompaniment.

Next, one example of the functional configuration of the electronic controller 201 according to the present embodiment will be described. As shown in FIG. 3, the electronic controller 201 functionally includes an identification module 301, an adjustment module 302, a mixing module 303, and an adjustment information acquisition module 304. In the present embodiment, a case in which the mixer 106 includes the identification module 301, the adjustment module 302, the mixing module 303, and the adjustment information acquisition module 304 will be described; however, the audio processing device according to the present embodiment is not limited to the foregoing, and can be configured such that part or all thereof are included in the mixer 106. For example, the audio processing device according to the present embodiment can include the identification module 301 and the adjustment information acquisition module 304, and the adjustment module 302 and the mixing module 303 can be included in the mixer 106.

The identification module 301 identifies each musical instrument corresponding to each audio signal. Then, the identification module 301 outputs the identified musical instruments to the adjustment module 302 as identification information. Specifically, based on each audio signal, the identification module 301 generates feature data of the audio signal and compares the feature data with feature data registered in the memory 202 to thereby identify the type of each musical instrument corresponding to each audio signal. Registration of feature data of each musical instrument to the memory 202 is, for example, configured using a learning algorithm such as an SVM (Support Vector Machine). The identification of the musical instruments can be carried out using the technique disclosed in Japanese Patent Application No. 2015-191026 and Japanese Patent Application No. 2015-191028; however, a detailed description thereof will be omitted.

Based on the combination of the identified musical instruments, the adjustment information acquisition module 304 acquires adjustment information associated with the combination from the memory 202. Here, for example, the memory 202 stores combination information representing combinations of musical instruments and adjustment information for adjusting each audio signal associated with each combination of musical instruments, as shown in FIGS. 4A and 4B.

Specifically, for example, the memory 202 stores musical instrument information (Inst.) representing vocal (Vocal) and guitar (Guitar) as combination information, and stores volume information (Vol), pan information (Pan), reverb information (Reverb.), and compression information (comp.), as adjustment information, as shown in FIG. 4A. In addition, the memory 202 includes musical instruments information (Inst.) representing the vocal (Vocal) and keyboard (Keyboard) as combination information and stores volume information (Vol), pan information (Pan), reveal information (Reverb.), and compression information (comp.) as adjustment information, as shown in FIG. 4B. That is, for example, when the identification module 301 identities a vocal and a guitar, the adjustment information acquisition module 304 acquires the adjustment information illustrated in FIG. 4A. The adjustment information shown in FIGS. 4A and 4B are examples, and the present embodiment is not limited thereto. In the description above, a case in which the combination information and the adjustment information are stored in the memory 202 was described; however, the combination information and the adjustment information can be acquired from an external database, or the like.

The adjustment module 302 adjusts each audio signal based on the adjustment information acquired by the adjustment information acquisition module 304. Each audio signal can be directly input to the adjustment module 302, or can be input via the identification module 301. As shown in FIG. 3, the adjustment module 302 comprises a level control module 305, a pan control module 306, a reverberation control module 307, a compression control module 308, and a side chain control module 309.

Here, the level control module 305 controls the level of each input audio signal. The pan control module 306 adjusts the sound localization of each audio signal. The reverberation control module 307 adds reverberation to each audio signal. The compression control module 308 compresses (compression) the width of change of the volume. The side chain control module 309 controls the turning on and off of effects that are controlled so as to affect the sounds of other musical instruments, using the intensity of sounds and the timings at which sound is emitted from a certain musical instrument. The functional configuration of the adjustment module 302 is not limited to the foregoing: for example, the functional configuration can include a function to control the level of audio signals in specific frequency bands, such as an equalizer function, a function to add amplification and distortion, such as a booster function, a low-frequency modulation function, and other functions provided to effectors. In addition, a portion of the level control module 305, the pan control module 306, the reverberation control module 307, the compression control module 308, and the side chain control module 309 can be provided externally.

Here for example, when the adjustment information shown in FIGS. 4A and 4B is acquired, the level control module 305 carries out a control such that the volume level of the vocal is represented by 1.0 and the volume level of the guitar is represented by 0.8. The pan control module 306 carries out a control such that the sound localization of the vocal (Vocal) is represented by 0.5 and the sound localization of the guitar (Guitar) is represented by 0.5. The reverberation control module 307 carries out a control so as to add reverberation represented by 0.4 to the vocal and reverberation represented by 0.4 to the guitar. The compression control module 308 turns on the compression function for the guitar. Since the adjustment information in FIGS. 4A and 4B assumes a case of solo singing accompaniment, and the guitar is assumed to be an acoustic guitar, the reverberation is set to be added thereto.

Figures 5, 6:
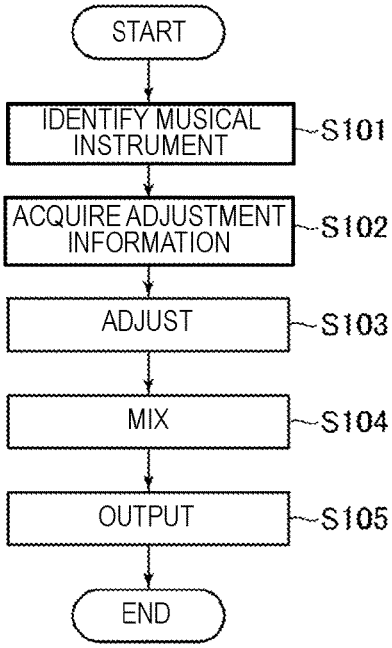
FIG. 5 shows one example of adjustment information in a case of a typical musical group.
FIG. 6 is a view for explaining one example of a process flow of the mixer.

FIG. 5 illustrates one example of adjustment information in the case of a typical musical group. In the case of a typical musical group, since it is likely that the guitar is an electric guitar, within the adjustment information, the reverberation corresponding to the guitar is set to be zero and the volume is set to be slightly lower. In addition, in order to improve the separation between the kick (Kick) and the bass (Bass), the kick and the bass are set to be side chains. Furthermore the snare (Snare) and the top microphone (left and right) (TopL, TopR) are set to be appropriately adjusted. Then, the level control module 305, the pan control module 306, the reverberation control module 307, the compression control module 308, and the side chain control module 309 control each of the audio signals based on the adjustment information in the same manner as described above; thus, the description thereof is omitted.

The mixing module 303 mixes each of the audio signals adjusted by the adjustment module 302 and outputs same to the amplifier 107.

Next, one example of the process flow of the mixer 106 according to the present embodiment will be described, using FIG. 6. As shown in FIG. 6, first, the identification module 301 identifies each musical instrument corresponding to each audio signal (S101). Based on the combination of the identified musical instruments, the adjustment information acquisition module 304 acquires adjustment information associated with the combination from the memory 202 (S102). The adjustment module 302 adjusts each audio signal based on the adjustment information acquired by the adjustment information acquisition module 304 (S103). The mixing module 303 mixes each of the audio signals adjusted by the adjustment module 302 (S104). Then, the amplifier 107 amplifies and outputs to the speaker 108 each the mixed audio signals (S105).

According to the present embodiment, for example, it is possible to more easily set the mixer. More specifically, according to the present embodiment, for example, by connecting the musical instruments to the mixer, each musical instrument is identified, and the mixer is automatically set according to the composition of the musical instruments, configured by said musical instruments.

The present invention is not limited to the embodiment described above, and can be replaced by a configuration that is substantially the same, a configuration that provides the same action and effect, or a configuration that is capable of achieving the same object as the configuration shown in the above-described embodiment.

Figures 7, 8:
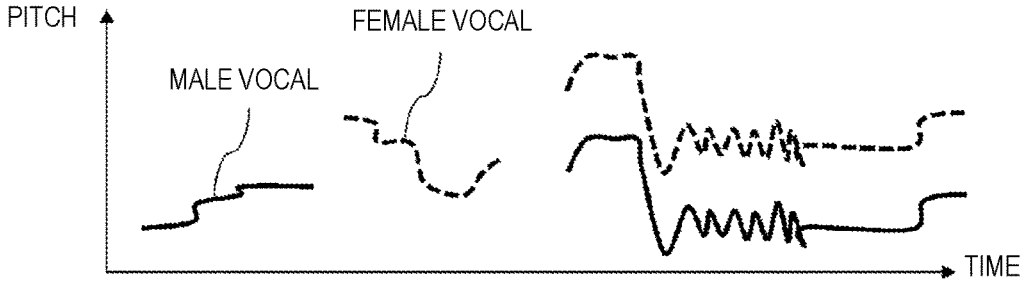
FIG. 7 is a view illustrating one example of adjustment information in a case that the composition of the musical instruments is changed.
FIG. 8 is a view illustrating one example of at pitch trajectory in a case of a duet.

For example, when the identification module 301 identifies the same musical instrument during a performance, the adjustment module 302 can appropriately adjust the position of said same musical instrument. Specifically, for example regarding the composition of the musical instruments shown in FIG. 5, when one more guitar is added, the pan information is changed such that the first guitar is adjusted from 0.5 to 0.35, and the second guitar is adjusted from 0.5 to 0.65, a shown in FIG. 7. In this case, for example, adjustment information such as that shown in FIG. 7 is stored in the memory 202 in advance, and the adjustment information acquisition module 304 acquires the adjustment information according to the combination of the musical instruments identified by the identification module 301, such that the adjustment is carried out based on said adjustment information. In addition, the amount of change for each musical instrument when the number of musical instruments increases can be stored, and the adjustment information can be changed according to said amount of change.

In addition to the configuration of the above-described embodiment, for example, a duet determination unit can be provided to the mixer 106, which determines the occurrence of a duet, in which a male and a female sine alternately or together, based on the pitch trajectory between channels identified as vocals. Then, for example, when the duet determination unit determines the occurrence of a duet the sounds of the loss pitch range can be raised by an equalizer included in the mixer 106 and the pan can be shifted slightly to the right with respect to the male vocals, and the sounds of the mid-pitch range can be raised and the pan can be shifted slightly to the left with respect to female vocals. It thereby becomes possible to more easily distinguish between male and female vocals.

Here, an example of a pitch trajectory in the case of a duet is shown in FIG. 8. As shown in FIG. 8, in the case of a duet, the pitch trajectories of the female vocals (indicated by the dotted line) and the male vocals (indicated by the solid line) appear alternately, and even if the pitches appear at the same time, the pitch trajectories appear differently. Therefore, the duet determination unit can be configured to determine the occurrence of a duet when, for example, the pitch trajectories appear alternatingly, and, even if appearing at the same time, the pitch trajectories are different by a predetermined threshold value or more. The duet determination unit is not limited to the configuration described above, and it goes without saying that the duet determination unit can have a different configuration as long as the duet determination unit is capable of determining the occurrence of a duet. For example, the duet determination unit can be configured to determine the occurrence of a duet when the rate at which the pitch trajectories appear alternatingly is a predetermined rate or more. In addition, the above-described adjustment when the occurrence of a duet is determined is also just an example, and no limitation is imposed thereby. Moreover, it is also possible to determine whether it is composed of a main vocal and a chorus, and when it is determined to be composed of a main vocal and a chorus, the volume of the main vocal can be further increased.

Additionally, a case in which adjustment information is held for each combination of the musical instruments was described above; however, a plurality of pieces of adjustment information can be stored, one for each music category, even with respect to the same combination of musical instruments, such that the audio signals are adjusted according to the music category specified by the user. Music categories can include genre (pop, classical, etc.) or mood (romantic, funky, etc.). The user can thereby enjoy music adjusted according to the composition of the musical instruments by simply specifying the music category, without performing complicated settings.

Furthermore, the mixer 106 can be configured to have a function to give advice on the state of the microphone (each of the microphones provided for each instrument). Specifically, for example, with respect to setting a microphone, using the technique disclosed in Japanese Laid-Open Patent Application No. 2015-080076, it can be configured to advise the user by displaying the sound pickup state of each microphone (for example, whether the arrangement position of each microphone is good or bad) on the display unit 240, or configured to give advice by means of sound from the mixer 106 by using a monitor speaker (not shown), or another technique, connected to the mixer 106. In addition, howling can be detected and pointed out, or the level control module can adjust the level of the audio signal so as to automatically suppress howling. Furthermore, the amount of crosstalk between microphones can be calculated from cross-correlation, and advice can be given to move or change the direction of the microphone, The audio processing device in the scope of the claims corresponds, for example, to the mixer 106 described above, but is not limited to a mixer 106, and can be realized, for example, with a computer.

What is claimed is:

1. An audio processing device comprising:

memory including combination information representing combinations of musical instruments;

an electronic controller including at least one processor; and a plurality of input terminals that receives audio signals from a plurality of musical instruments, the electronic controller configured to execute a plurality of modules including an identification module that identifies each of the musical instruments corresponding to each of the audio signals that generates feature data of the audio signals and that compares the feature data that was generated with the combination information in the memory, and an adjustment information acquisition module that acquires adjustment information associated with a combination of the musical instruments identified by the identification module from the memory, and that adjusts each of the audio signals according to the combination of the musical instruments identified by the identification module and the combination information in the memory.

2. The audio processing device as recited in claim 1, further comprising the adjustment information is associated with each combination of the musical instruments.

3. The audio processing device as recited in claim 1, further comprising the electronic controller further includes an adjustment module that adjusts each of the audio signals based on the adjustment information.

4. The audio processing device as recited in claim 3, further comprising a mixer unit that mixes the audio signals adjusted by the adjustment module.

5. The audio processing device as recited in claim 3, wherein the adjustment module comprises at least one of a level control module for controlling a level of each of the audio signals, a reverberation control module for adding reverberation sounds to each of the audio signals, and a pan control module for controlling a localization of each of the audio signals.

6. The audio processing device as recited in claim 1, wherein the adjustment information acquisition module further acquires the adjustment information in accordance with a music category specified by a user from a plurality of pieces of the adjustment information regarding the same combination of the musical instruments for each music category information representing a desired music category.

7. The audio processing device as recited in claim 1, wherein the processor further adjusts each of the audio signals based on pitch trajectories between audio signals determined to be vocals.

8. The audio processing device as recited in claim 7, further comprising a duet determination unit configured to determine an occurrence of a duet in which a male and a female sing alternately or together based on the pitch trajectories, and adjusts each of the audio signals upon determination of the occurrence of the duet.

9. The audio processing device as recited in claim 1, wherein when the identification module identifies a plurality of the same musical instruments, the adjustment information acquisition module changes the adjustment information relating to positions of the plurality of the same musical instruments.

10. An audio processing method comprising:

registering combination information representing combinations of musical instruments in memory;

receives audio signals from musical instruments being played:

identifying each of the musical instruments corresponding to each of the audio signals that were received;

generating feature data of the audio signals that were received and comparing the feature data that was generated with the combination information in the memory;

acquiring adjustment information from the memory that is associated with a combination of the musical instruments identified; and adjusting each of the audio signals based on the combination information in the memory according to the combination of the musical instruments identified.

11. The audio processing method as recited in claim 10, further comprising associating the adjustment information with each combination of the musical instruments.

12. The audio processing method as recited in claim 10, further comprising adjusting each of the audio signals based on the adjustment information.

13. The audio processing method as recited in claim 12, further comprising mixing the audio signals adjusted by the adjustment module.

14. The audio processing method as recited in claim 12, further comprising controlling a level of each of the audio signals, adding reverberation sounds to each of the audio signals, and controlling a localization of each of the audio signals.

15. The audio processing method as recited in claim 10, wherein the acquiring of the adjustment information is further carried out in accordance with a music category specified by a user from a plurality of pieces of the adjustment information regarding the same combination of the musical instruments for each music category information representing a desired music category.

16. The audio processing method as recited in claim 10, further comprising adjusting each of the audio signals based on pitch trajectories between audio signals determined to be vocals.

17. The audio processing method as recited in claim 16, further comprising determining an occurrence of a duet in which a male and a female sing alternately or together based on the pitch trajectories, and adjusting each of the audio signals upon determination of the occurrence of the duet.

18. The audio processing method as recited in claim 10, further comprising changing the adjustment information relating to positions of the same musical instruments when a plurality of the same musical instruments are identified in the audio signals.

* * * * *